United States Patent [19]

Labrijn

[11] Patent Number: 4,934,051

[45] Date of Patent: Jun. 19, 1990

[54] SHAVING APPARATUS WITH A DETACHABLE HEAD

[75] Inventor: Hans Labrijn, Drachten, Netherlands

[73] Assignee: U.S. Philips Corp., New York, N.Y.

[21] Appl. No.: 249,611

[22] Filed: Sep. 26, 1988

[30] Foreign Application Priority Data

Oct. 5, 1987 [NL] Netherlands ..... 8702362

[51] Int. Cl.[5] ..... B26B 19/14

[52] U.S. Cl. ..... 30/43.6; 30/346.51

[58] Field of Search ..... 30/43.4, 43.5, 43.6, 30/346.51, 43.7–43.9, 43.91, 43.92

[56] References Cited

FOREIGN PATENT DOCUMENTS 7607258 1/1978 Netherlands ..... 30/43.6

*Primary Examiner*—Douglas D. Watts

*Attorney, Agent, or Firm*—Ernestine C. Bartlett

[57] ABSTRACT

A shaving apparatus is provided which comprises a housing having a detachable shaving head which has at least one opening for a shaving unit, which shaving unit comprises an external shaving member formed with hair entry apertures, and an internal shaving member which is drivable relative to the external shaving member. Inside the shaving head a retaining plate is arranged, to which plate the external shaving member is detachably secured, the internal shaving member being retained between the external shaving member and the retaining plate. The retaining plate is secured to the housing so as to be detachable independently of the shaving head and the shaving head is movable both relative to the housing and relative to the retaining plate with the shaving members.

3 Claims, 2 Drawing Sheets

SHAVING APPARATUS WITH A DETACHABLE HEAD

FIELD OF THE INVENTION

The invention relates to a shaving apparatus comprising a housing provided with a detachable shaving head having at least one opening for a shaving unit, which shaving unit comprises an external shaving member formed with hair-entry apertures, an internal shaving member which is drivable relative to the external shaving member, and a retaining plate arranged inside the shaving head, to which plate the external shaving member is detachably secured, the internal shaving member being retained between the external shaving member and the retaining plate.

BACKGROUND OF THE INVENTION

Such a shaving apparatus is known, for example from Netherlands Patent Application No. 8600154 which corresponds substantially to U.S. Pat. No. 4,711,028 issued Dec. 8, 1987. The disadvantage of this prior-art construction is that when the shaving head is removed from the apparatus, for example for the purpose of cleaning, the shaving unit and the retaining plate are also removed from the remainder of the apparatus. For example, for cleaning the shaving head further disassembly is required, in which case it is not unlikely that the parts are damaged or mislead. Moreover, if the apparatus comprises a plurality of shaving units, a shaving member of a shaving unit may be interchanged with that of an adjacent unit, which is undesirable.

SUMMARY OF THE INVENTION

An object of the invention is to mitigate these drawbacks and to this end the invention is characterized in that the retaining plate is secured to the housing so as to be detachable independently of the shaving head, and the shaving head is movable both relative to the housing and relative to the retaining plate with the shaving members.

Special embodiments are defined subsequently herein and include the apparatus when the shaving head is movable relative to the housing between an operational position, in which the shaving head engages against the housing, and a cleaning position, in which the shaving head is spaced from the housing and in which it is connected to the housing by at least one supporting element; and/or wherein the supporting element is constructed as an arm which is slidably arranged in the housing and which has one end engaging with a resilient element and another end engaging with the shaving head; and/or the supporting member comprises a resilient leg which engages behind a wall portion of the housing in the operational position, the housing comprising a movable release member which engages against the resilient lug and which is provided with an actuating knob situated in a wall of the shaving apparatus.

BRIEF DESCRIPTION OF THE DRAWING

An embodiment of the invention will now be described in more detail, by way of example, with reference to the Figures.

DETAILED DESCRIPTION OF THE PREFERRED EMBODIMENTS

Figure 1:
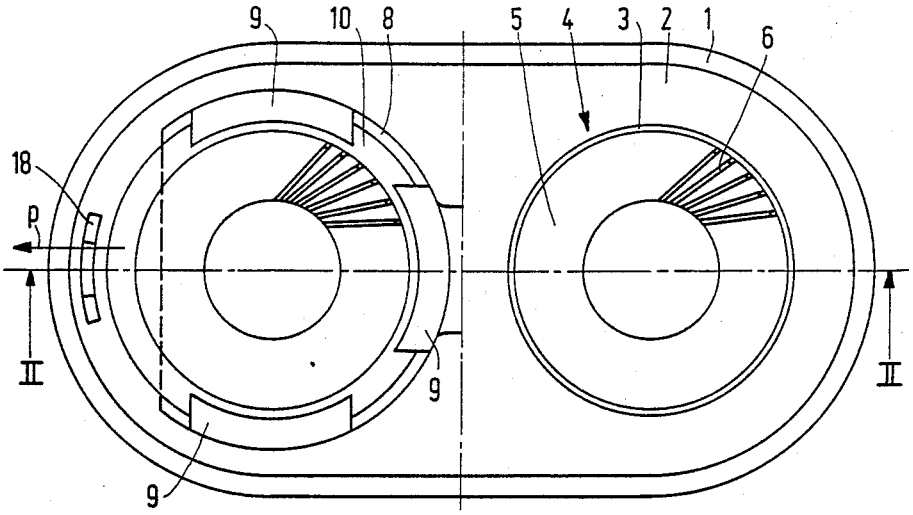
FIG. 1 is a plan view of a twin-head shaving apparatus, the shaving head not being shown in the left-hand part of the Figure.
Figure 2:
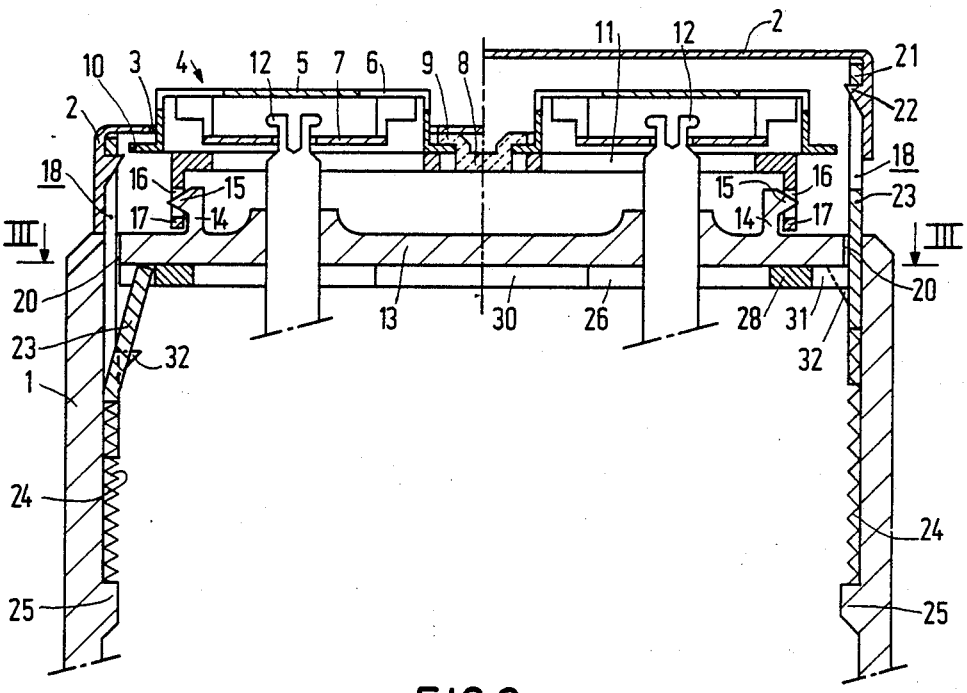
FIG. 2 is a sectional view taken on the line II—II in FIG. 1, the shaving head being shown in the lifted position in the right-hand part of the Figure.
Figure 3:
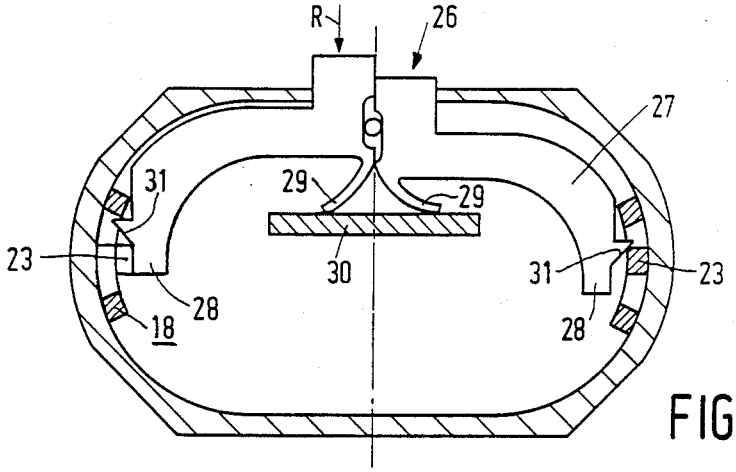
FIG. 3 is a sectional view taken on the line III—III in FIG. 2.

The shaving apparatus shown in FIGS. 1 to 3, comprises a housing 1 having a detachable shaving head 2. The shaving units 4 are situated in openings 3 in the shaving head. A shaving unit 4 comprises an external shaving member 5 with hair entry apertures 6 and an internal shaving member 7 which is drivable relative to the external shaving member 5. The external shaving members 5 are detachably secured to a retaining plate 8 arranged inside the shaving head 2, the internal shaving members 7 being retained between the external shaving members 5 and the retaining plate 8. The retaining plate 8 comprises clamping edges 9 which engage with the flange portion 10 of the external shaving member 5. In this way the external shaving members are clamped onto the retaining plate 8. The external shaving member 5 and the associated internal shaving member 7 can be detached from the retaining plate 8 by a movement in the direction indicated by the arrow P. By a movement in a direction opposite to that indicated by the arrow P the shaving unit can be refitted onto the retaining plate. The retaining plate 8 has an aperture 11 to enable the drive shafts 12 to be coupled to the internal shaving members 7. By means of a drive mechanism, which is known per se and which is not shown, the internal shaving members 7 can thus be rotated relative to the external shaving members 5.

The housing wall 13 comprises projections 14 having hook-shaped ends 15. These hook-shaped ends 15 engage in openings 16 in resilient lugs 17 on the retaining plate 8. In this way the retaining plate 8 is secured to the housing by means of a snap connection so as to be detachable independently of the shaving head 2. The shaving head 2, may for example, be clamped onto the housing 1 and in the construction described above it is movable both relative to the housing 1 and relative to the retaining plate 8 with the shaving unit 4. This is of particular importance, for example, if the apparatus is to be cleaned. The shaving head can then be removed without the parts of the shaving units coming apart and being interchanged or lost. For cleaning the shaving units these units can be removed individually from the retaining plate. This construction is of particular importance if the shaving apparatus can be cleaned with water. The shaving head 2 is then removed but the shaving units 4 remain coupled to the apparatus via the retaining plate 8. Cleaning is then possible by means of a water jet while the apparatus is switched on, so that the internal shaving members are rotated relative to the external shaving members, which provides a highly effective cleaning action.

It is alternatively possible to construct an embodiment in which the shaving head is movable relative to the housing between an operational position, in which the shaving head engages against the housing, and a cleaning position, in which the shaving head is spaced from the housing and is connected to the housing by at least one supporting element.

Figure 6:
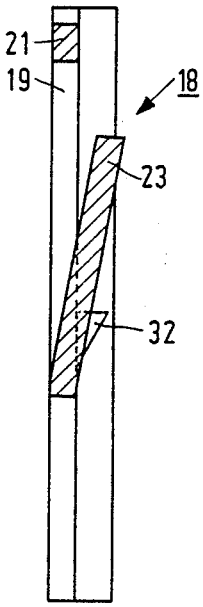
FIG. 6 is a sectional view taken on the line VI—VI in FIG. 4.
Figure 4:
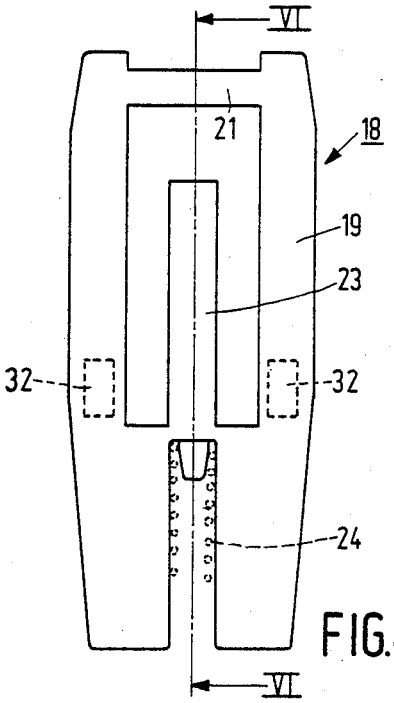
FIG. 4 shows a supporting element for the shaving head.
Figure 5:
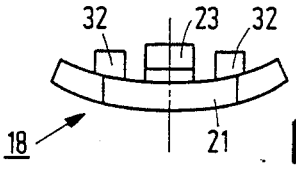
FIG. 5 is a plan view of the supporting element shown in FIG. 4.

In the embodiment shown in the Figures two supporting elements 18 (see in particular FIGS. 4, 5 and 6) lie against the inner side of the housing 1 and in cross-section (FIG. 5) they are slightly curved in conformity with the curvature of the housing at this location. A supporting element 18 comprises a frame-like member 19 having one end which extends through an opening 20 in the housing wall 13 and which engages against the inner side of the shaving head 2. The supporting element 18 comprises a transverse limb 21 which engages behind a hook-shaped projection 22 on the inner side of the shaving head 2. The elasticity of the supporting element 18 enables the transverse limb to be deflected away from the projection 22. In this way the shaving head 2 is detachably secured to the supporting elements 18. In the position as shown in the left-hand part of FIG. 2 a resilient arm 23 of the supporting element 18 engages against the underside of the housing wall 13. A compression spring 24 is arranged between an abutment 25 on the wall of the housing 1 and the supporting element 18.

The shaving apparatus comprises a release member 26 (FIG. 3) which engages against the underside of the wall 13 and which comprises arms 27 whose end portions 28 extend up to the resilient arms 23 of the supporting elements 18. The release member 26 also comprises resilient arms 29 which engage against a stop 30 of the housing 1. The release member 26 can be moved in the direction indicated by the arrow R against the action of the resilient arms 29. The inclined surfaces 31 of the end portions 28 then abut against the resilient arms 23 to move these arms 23 into a position as shown in the right-hand part of FIGS. 2 and 3. The compression springs 24 can now urge the supporting elements 18 upwards through the openings 20 to move the shaving head into a second position in which the projections 32 engage against the underside of the housing wall 13. In this postion, referred to as the cleaning position, in which the shaving head is spaced at some distance above the housing, the shaving units are accessible for cleaning purposes (see the right-hand part of FIG. 2). This has the advantage that for cleaning the shaving units, for example by means of a water jet, the shaving head need not be detached from the apparatus and cannot be mislaid. By exerting pressure on the shaving head this head can be pressed back into the operational position against the action of the compression springs 24, the resilient arms 23 then engaging behind the housing wall 13 (left-hand part of FIGS. 2 and 3).

What is claimed is:

1. A shaving apparatus comprising a housing provided with a detachable shaving head having at least one opening for a shaving unit, which shaving unit comprises an external shaving member formed with hair-entry apertures, an internal shaving member which is drivable relative to the external shaving member and a retaining plate arranged inside the shaving head, to which plate the external shaving member is detachably secured, the internal shaving member being retained between the external shaving member and the retaining plate, wherein the retaining plate is secured to the housing so as to be detachable independently of the shaving head, and the shaving head is movable both relative to the housing and relative to the retaining plate with the shaving members, the shaving head being movable relative to the housing between an operational position, in which the shaving head engages against the housing, and a cleaning position, in which the shaving head is spaced from the housing and in which it is connected to the housing by at least one supporting element.

2. A shaving apparatus as claimed in claim 1, wherein the supporting element is constructed as an arm which is slidably arranged in the housing and which has one end engaging with a resilient element and another end engaging with the shaving head, of a resilient element whose other end engages with the shaving head.

3. A shaving apparatus as claimed in claim 2, wherein the supporting element comprises a resilient lug which engages behind a wall portion of the housing in the operational position, the housing comprising a movable release member which engages against the resilient lug and which is provided with an actuating knob situated in a wall of the shaving apparatus.

* * * * *